United States Patent [19]

Okano

[11] Patent Number: 4,828,525

[45] Date of Patent: May 9, 1989

[54] REMOTE LIGHT CONTROLLED TOY VEHICLE

[75] Inventor: Masaru Okano, Tokyo, Japan

[73] Assignee: Estona Incorporated, Tokyo, Japan

[21] Appl. No.: 119,039

[22] Filed: Nov. 10, 1987

[30] Foreign Application Priority Data

May 22, 1987 [JP] Japan ..... 62-76864[U]

[51] Int. Cl.[4] ..... A63H 30/00; A63H 17/40; A63H 17/26; A63H 30/02

[52] U.S. Cl. ..... 446/175; 446/441; 446/448; 446/455

[58] Field of Search ..... 446/175, 441, 448, 455

[56] References Cited

U.S. PATENT DOCUMENTS

| | | | |
|---|---|---|---|
| 2,838,876 | 6/1958 | Smith, Jr. | 446/175 |
| 2,921,408 | 1/1960 | Leblic | 446/175 |
| 3,314,189 | 4/1967 | Carroll | 446/175 |
| 3,386,406 | 6/1968 | Tsunoda | 446/175 |
| 3,961,441 | 6/1976 | Sato | 446/175 |
| 4,086,724 | 5/1978 | McCaslin | 446/175 |
| 4,165,581 | 8/1979 | Wolf | 446/175 |
| 4,201,012 | 5/1980 | Marshall | 446/175 |

FOREIGN PATENT DOCUMENTS

| | | | |
|---|---|---|---|
| 2055584 | 1/1980 | United Kingdom | 446/175 |

*Primary Examiner*—Robert A. Hafer
*Assistant Examiner*—Michael Brown
*Attorney, Agent, or Firm*—Kalish & Gilster

[57] ABSTRACT

Remote light controlled toy vehicle is provided with a transmitting source for infrared rays of predetermined frequency through a predetermined angle of radiation and a mobile toy operatively responsive to reception of the infrared rays. The mobile toy has at least first and second wheels and a motor; with there being a first gear train permanently connecting the motor and the first wheel and with there being a disengageable second motor gear train connecting the motor and the second wheel; the second motor train incorporating shiftable components so that upon rotation of the motor shaft in, one direction, motion transmission is inhibited. The vehicle contains first and second prima movers; the first being non-reactive to the infrared ray emissions so that the first gear train will operate with the other, or second, being inactive whereby the vehicle will tend to rotate about its vertical axis. A photosensitive element is suitably interconnected between the second prime mover and the infrared source so that upon activation by the source, the second gear train will concurrently operate with the first gear train whereby the vehicle will be caused to travel in a rectilinear path.

9 Claims, 4 Drawing Sheets

REMOTE LIGHT CONTROLLED TOY VEHICLE

FIELD OF THE INVENTION

The present invention relates, in general, to remotely controlled toys, and, more particularly, to a toy vehicle adapted for rotational and rectilinear movement responding to a remotely located light source.

DESCRIPTION OF THE PRIOR ART

In conventional systems in which a rotating mobile toy body, for example, a toy vehicle, is caused to be moved responsively to reception of a light signal from a remotely controlled source, the rotation of a relatively small motor mounted on the toy body is transmitted to one of the rear wheels while the other rear wheel is disengaged from the motor so, as a result, the vehicle rotates about its vertical axis. While in such rotating condition, a remote-control transmitter is caused to transmit, by means of an antenna, a signal of predetermined frequency. Upon reception of such signal by a receiver on the toy body, the motor is switched from a forward rotation to a rearward rotation, which latter is transmitted to both rear wheels. Thus, the toy vehicle discontinues rotation on its vertical axis and assumes straight-line or rectilinear movement which will continue as long as the transmitted signal is being received. Therefore, in order to cause the toy to travel responsively to the signal, a transmission control button on the transmitter is depressed and then released in order to effect by such transmission and interruption or cessation of transmission the correction of the direction in which the toy is moving so as to cause the same to travel directly toward the transmitter.

Thus, with current devices such as that hereinabove described, a signal transmitted by a rod antenna is received on a similar rod antenna provided on the side of the mobile toy which is rotating on its axis so that the attitude thereof with respect to the direction of the signal is indeterminate. Therefore, when such toy vehicle receives a transmitted signal and the motor is shifted to rearward rotation, the toy vehicle may travel in a circular direction, that is, within a 360° path, so that it cannot necessarily advance toward the transmitter. The toy may even be advanced in a straight path in a direction away from the transmitter. In order to cause the toy to invariably travel responsively toward the transmitter, it is necessary that the user observe the heading of the front end of the rotating toy vehicle so that depression of the transmission control button will be effected at a juncture for control of the toy vehicle, which operation requires a relatively high degree of technique.

SUMMARY OF THE PRESENT INVENTION

The present invention comprises a transmitter for emitting an infrared signal at a predetermined frequency and at a predetermined angle of radiation, with the toy being adapted to rotate about its longitudinal axis and to travel along a rectilinear path by means of an integrated drive device. The toy is provided with a receiver for the infrared signal from the transmitter and a control unit for automatically switching the drive device so that it rotates the toy when no infrared signal is received and causes the vehicle to travel along a straight or rectilinear path when receiving an infrared signal whereby the same advances toward the transmitter in a zigzag manner within the range of the angle at which the infrared rays are radiated.

Therefore, it is an object of the present invention to provide a remote controlled mobile toy which is adapted for automatic travel toward a signal transmitter responsively to emission of a signal directed at the toy; which system is easy to operate and suitable for use by young children.

It is a further object of the present invention to provide a remote controlled toy which is desirably of vehicle-like character and is designed, in response to operation of a remotely controlled light source, to effect either rotational or rectilinear movement as dictated by reception of a signal from a light source and to thereby provide a subject of extreme fascination for, as well as of rapt curiosity by, young children.

It is still another object of the present invention to provide a remotely controlled toy of the type stated which is constructed of a simplicity of durable components so that the same are resistant to breakdown and thereby assure of durability in usage as well as conduce to marked economy in production.

BRIEF DESCRIPTION OF THE DRAWINGS

FIG. 2(*b*) is a fragmentary vertical side view in partial section taken along the line B—B of FIG. 2(*a*).

DETAILED DESCRIPTION OF PRACTICAL EMBODIMENT

Figure 1:
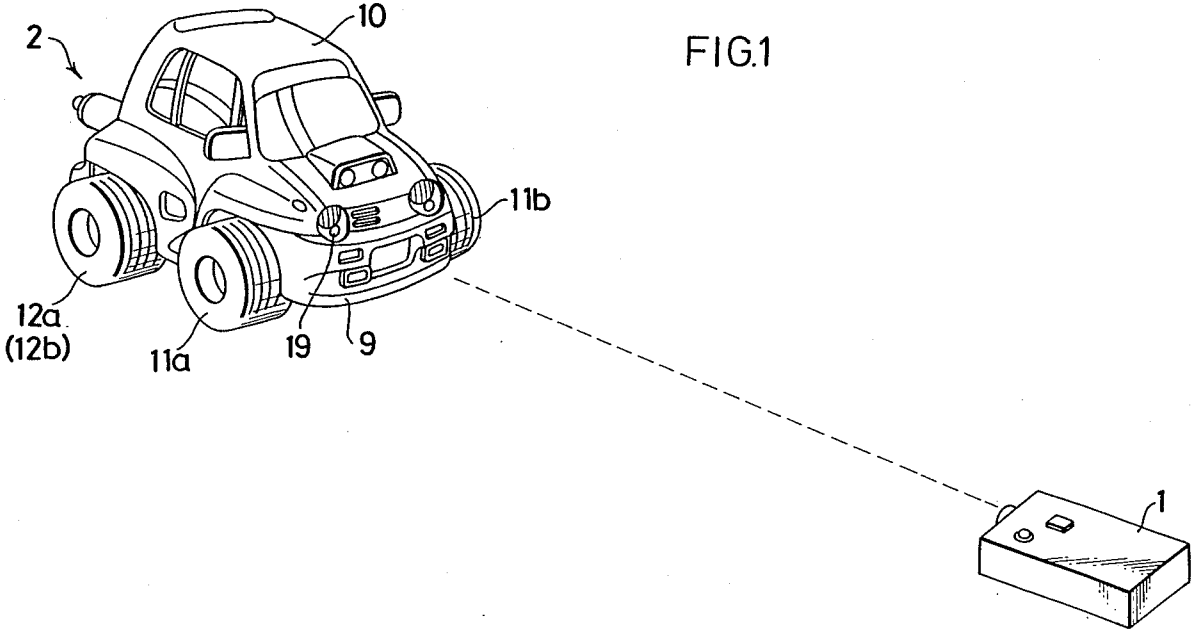
FIG. 1 is a perspective view of a toy vehicle in relation to the remote light control source which are constructed in accordance with and embodying the present invention.
Figure 2A:
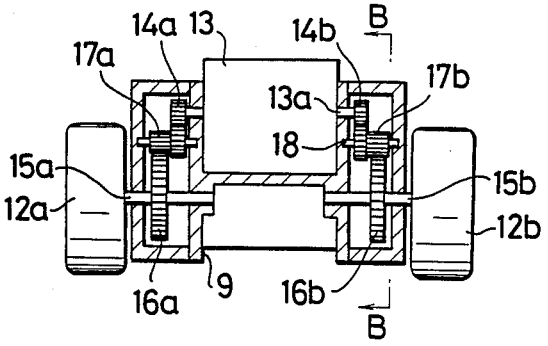
FIG. 2(*a*) is a bottom plan view in partial section of the rearward end of the toy vehicle illustrating the motion transmission system of the toy illustrated in FIG. 1.
Figure 2B:
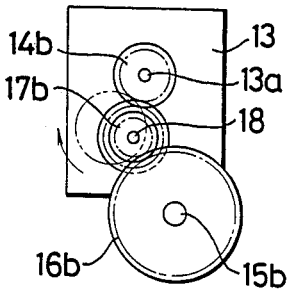

Referring now by reference characters to FIGS. 1 to 4, inclusive, reference numeral 1 designates a transmitter adapted for emission of light at a predetermined frequency, such as, in the present instance, preferably, within the infrared range. Transmitter 1 is designed so that the emissions are effected within a sector or angle of radiation of preselected degree which, for illustration, is approximately 60°. Transmitter 1 may be disposed upon a suitable surface or may be hand-held by the operator for infrared emissions toward a mobile toy 2 which in FIGS. 1 to 4 is depicted as a four-wheeled toy vehicle.

Figure 3A:
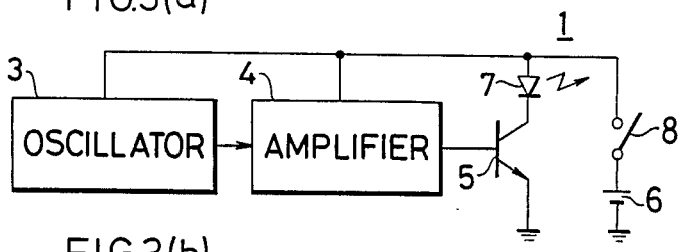
FIG. 3 is a block diagram of the transmitter and receiver.
Figure 3B:
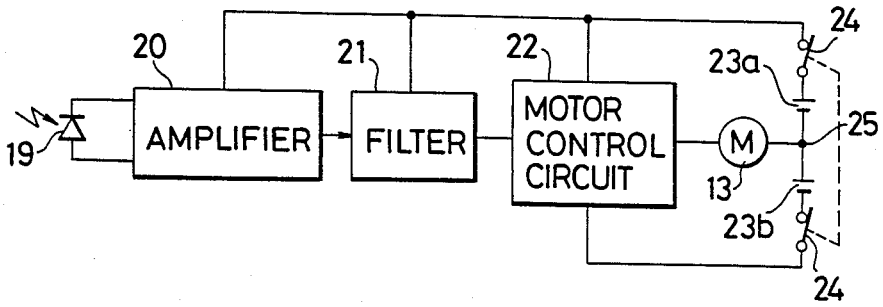

With reference to FIG. 3, which diagramatically illustrates transmitter 1, it will be seen that the latter includes an oscillator circuit 3 for generating the desired frequency; an amplifier circuit 4 for amplifying the output from oscillator circuit 3; a switching transistor 5 driven by the output signal from amplifier circuit 4 and an infrared ray generating diode 7 connected across the collector of transistor 5 and a battery source 6.

A power source switch 8 is provided between battery 6 and diode 7 so that when closed or in "on" position, diode 7 will emit infrared rays having the predetermined frequency within the preselected directional angle, which, for example, may be in the range of 60°-90°.

Mobile toy 2 which is shown as a toy vehicle in FIGS. 1 to 4 and includes a stylized chassis 9, a body 10, a pair of front wheels 11*a*, 11*b* and a pair of rear wheels 12*a*, 12*b* which latter are carried on chassis 9. A motor 13 is positioned between rear wheels 12*a* and 12*b* (see FIG. 2*a*). Motor 13 is provided with a rotatable shaft 13*a* projecting at the opposite ends thereof beyond the proximate side of motor 13 and with drive gears 14*a*, 14*b*, respectively, fixed thereon. Support shafts or axles 15*a*, 15*b* for rear wheels 12*a*, 12*b*, respectively, are journalled in suitable bearings provided in chassis 9 and fixed on each of said shafts 15*a*, 15*b* is a pinion 16*a*, 16*b*, respectively. Pinion 16*a* and drive gear 14*a* respectively mesh with different stages of a two-stage intermediate gear 17*a* supported rotatably on shaft 18 axially parallel to, and between, shafts 15*a* and 13*a*. The other pinion, 16*b* and drive gear 14*b* mesh with intermediate gear 17*b* also of two-stage structure which gear 17*b* is rotatably carried by a shaft on chassis 9 by suitable conventional means so that it can move, i.e., shift in a planetary manner around drive gear 14*b* through a predetermined angle, as for example, about 30° (see FIG. 2(*b*)). Thus, while motor 13 is rotating in the forward direction, intermediate gear 17*b* is shown to shift from and be separated from, or out of contact with, drive pinion gear 16*b* (as shown in phantom lines in FIG. 2(*b*)) whereby transmission of rotation from motor 13 to rear wheel 12*b* is interrupted or discontinued; simultaneously rotation of rear wheel 12*a* is effected and thereby causes the toy body to rotate about its vertical axis. However, when motor 13 is reversed, that is, rotating in the rearward direction, intermediate gear 17*b* moves and is thereby caused to be brought into restored engagement with drive pinion gear 16*b* and hence cause transmission of rotation from motor 13 to rear wheel 12*b*. In this condition, both rear wheels 12*a* and 12*b* are being rotated simultaneously in the same or forward direction thereby causing the toy body 2 to travel in a straight or rectilinear path as indicated by the arrows in FIG. 4 between points indicated P1 and P2.

Mobile toy body 2 contains a photosensitive element 19 for receiving infrared rays transmitted from the spacedly located transmitter 1 which element is disposed in a headlight-simulative part of toy body 2 (see FIG. 1). The directional reception angle of photosensitive element is in the neighborhood of 15°.

FIG. 3(*b*) illustrates a block diagram showing one example of a motor control circuit suitable for provision within mobile body 2 wherein reference numeral 20 indicates an amplifier for the electric signal obtained from photosensitive element 19 when the latter receives infrared rays. Connected to amplifier 20 is a filter 21 for detecting a signal having the preselected frequency emitted from transmitter 1. The output from filter 21 is supplied to a motor control circuit 22 to which said filter 21 is connected; said motor control circuit being, preferably, a solid state relay or an electronic relay. When circuit 22 is in the receptive mode for output from filter 21, that is, when photosensitive element 19 is in infrared receiving state, motor 13 is controlled so that the latter is rotated rearwardly and toy body 2 hence is travelling in a straight or rectilinear path. Motor 13 is rotated oppositely or forwardly when photosensitive element 19 is in the non-receiving mode for the infrared rays which would be when said element 19 is not located for reception within the particular angle of radiation of transmitter 1. Toy body 2 is then caused to rotate about its vertical axis since rear wheel 12*b* will be in a non-rotative or stationary condition so that the rotation of rear wheel 12*b* will be driving vehicle body 12 about its vertical axis. Motor 13 is connected at one side to motor control circuit 22 and at the other side thereof directly to a junction 25 between opposed sides of a pair of power or battery sources 23*a*, 23*b*, respectively carried on mobile body 2. The mutually remote sides of battery sources 23*a*, 23*b* are respectively connected to a power source switch 24 for motor control circuit 22, being swingable between circuit-closed condition as shown in FIG. 3(*a*) and circuit-open state.

Figure 4:
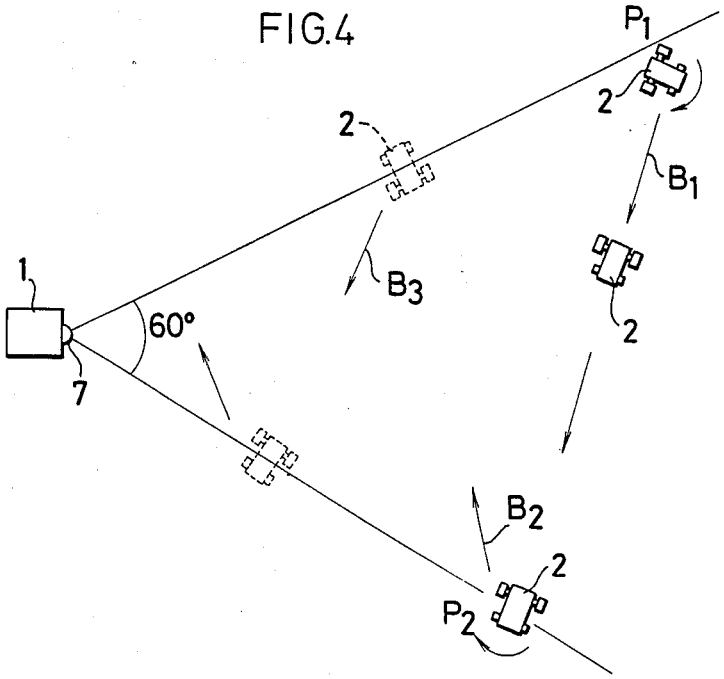
FIG. 4 is a generally diagramatic view illustrating the movement of the toy vehicle responsive to operation of the transmitter.

The operation of mobile toy 2 as described above will now be set forth: at the outset, power source switch 24 of mobile body 2 is turned to "on" condition or placed in circuit-closing state. Motor control circuit 22 then supplies power to motor 13 in a closed circuit comprising power source 23*a*, motor control circuit 22, motor 13, and power source 23*a* so that motor 13 is then caused to rotate forwardly. When motor 13 is rotated forwardly, rotation is transmitted from shaft 13*a* through drive gear 14*a*, intermediate gear 17*a* and pinion 16*a* to rear wheel 12*a* for rotation of the latter; with the other drive gear 14*b* being rotated forwardly as a unit with motor rotating shaft 13*a*, intermediate gear 17*b* meshing with shaft 13*a* is moved in the direction indicated by the lower arrows in FIG. 2(*b*) into the position shown in phantom lines for disengagement from pinion 16*b* so that the other rear wheel 12*b* is not drivingly rotated. Therefore, mobile body 2 rotates about the vertical axis thereof as at a position indicated at P1 as shown by the arrow A in FIG. 4 since one rear wheel 12*a* is rotating while the other rear wheel 12*b* is in non-rotative condition. Under such state, when power source switch 8 of transmitter 1 is switched to "on" or circuit-closed condition, diode 7 is caused to emit infrared rays which are transmitted toward the now rotating mobile body 2. Assuming at this time that the radiation angle of the light signal from infrared diode 7 is 60°, as indicated in FIG. 4, it will be seen that mobile body 2 is in non-receptive disposition for the transmitter emissions and thus rotation will be continued until photosensitive element 19 is brought within the path of radiation.

When the infrared ray detecting element 19 of mobile body 2 moves into the path of light emissions during rotation of body 2 to receive the signal radiated from transmitter 1, the latter is converted to an electric signal which is then applied to filter 21 from which latter passes only the signal from transmitter 1. The resulting signal is then output to motor control circuit 22 wherein the latter is actuated to thereby supply power to motor 13 in the direction opposite to that indicated above; being in a closed circuit including power source now 23*b*, motor 13, motor control circuit 22 and the other side of battery power source 23*b* to thereby cause motor 13 to rotate rearwardly with the resulting rotation being transmitted to rear wheel 12*a* through drive gear 14*a*, intermediate gear 17*a* and pinion 16*a* so that rear wheel 12*a* will reverse direction of rotation and thus rotate in a manner to cause rectilinear travel of mobile body 2. Concurrently, the other drive gear 14*b* is rotated rearwardly as a unit with motor rotating shaft 13*a*, intermediate gear 17b meshing with rotating drive gear 14b is then changed i.e., shifts from the position shown by phantom lines in FIG. 2(*b*) to the state shown in solid lines so as to effect a meshing with pinion gear 16b whereby rear wheel 12b is also rotated in the direction in which the mobile body 2 is advancing so that mobile body 2 will thereupon discontinue rotation on its vertical axis and now move in a straight path by virtue of the concurrent rotation of rear wheels 12a, 12b in the same forward direction. Accordingly, mobile body 2 at this juncture, receiving infrared rays from transmitter 1 for energizing switch motor 13 for rearward rotation, body 2 will move in a direction indicated by the arrow B1 as shown in FIG. 4. With mobile body 2 thus advancing along a straight line as indicated by arrow B1 toward point P2, such travel will continue until the photosensitive element 19 is beyond the angular range of radiation of infrared rays from transmitter 1 so that the same can no longer be received. Thereupon motor 13 is again rotated forwardly to cause rotation of body 2 on its vertical axis at position P2 (FIG. 4). When photosensitive element 19 reenters the zone defined by the angle of radiation from transmitter 1 during rotation of mobile body 2 at point P2, it will once again receive infrared rays from transmitter 1 and motor 13 will be returningly switched to rotation in the opposite direction, or rearwardly, and thereby cause mobile body 2 to resume a straight or rectilinear path of travel as in the direction of the arrow B2 as shown in FIG. 4. Thereafter, similarly, mobile body 2 will ultimately repeat its rotation about its vertical axis or straight line travel dependent upon the attitude of photosensitive element 19 to transmitter 1 and thus move in a generally zigzag manner toward transmitter 1, all, understandably, within the angular range of radiation of infrared from transmitter 1. Ultimately, it will arrive at transmitter 1, all as is diagramatically depicted in FIG. 4.

Therefore, in the remote controlled infrared ray mobile toy of this embodiment, only by transmission of infrared rays from transmitter 1 toward the mobile body 2 rotating on its axis, can body 2 be automatically advanced in its unique course. The operation of mobile body 2 is easily accomplished, not requiring marked technique or skill as would be necessary with prior art devices. Thus, even a child of tender years can play with this toy with pleasure and fascination without having to be schooled in involved operating procedures.

Figure 5:
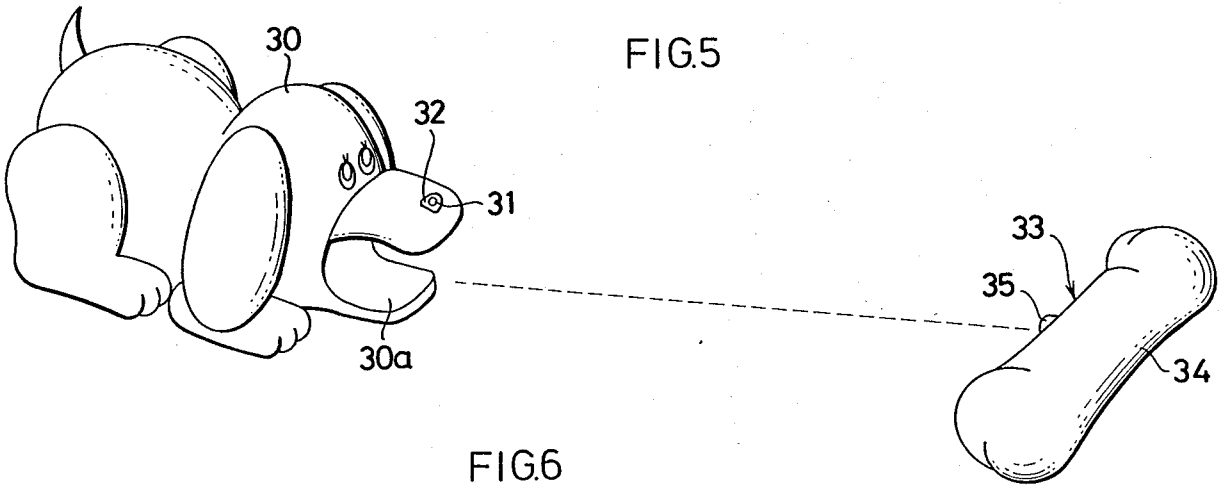
FIG. 5 is a schematic view of another mobile toy constructed in accordance with and embodying the present invention and illustrating same in spaced relation to a light control source.
Figure 6:
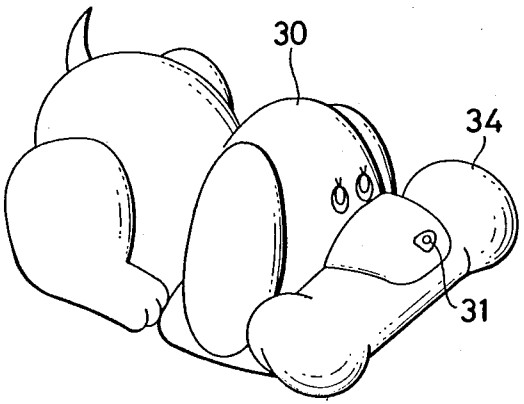
FIG. 6 is a perspective view of the mobile toy illustrated in FIG. 5 but showing same in position upon termination of travel toward the light source.

FIGS. 5 and 6 illustrate another version of the present invention wherein 30 indicates a mobile toy which is in the form of a simulative puppy designed to operate with a remote light control source, such as of infrared rays. In this embodiment, toy D includes an infrared signal receiver circuit as illustrated diagramatically in FIG. 3(*a*) and with like reference characters referring to like elements, as described above, and also includes a small motor, a train of gears for transmitting rotation of the motor to the rear wheels (not shown), a control circuit, and a photosensitive element indicated 31. The latter with the present form of toy D may be presented at the portion thereof which simulates the nose 32 of the animal depicted so that it is presented forwardly. A casing 34 for an infrared ray or otherwise light transmitter, which corresponds in all respects to transmitter 1 hereinabove described, may assume the form of a bone for correlation with the particular design of toy D and be dimensioned for reception within the mouth-simulative portion of toy D as indicated at 30a. Provided in casing 34 is a transmitter circuit having the same components as shown diagramatically in FIG. 3(*a*). A diode 35 which generates infrared rays is provided centrally of casing 34. In this embodiment, if toy D is permitted to rotate on its axis upon a floor or other support surface, transmitter 33 is located at a relatively remote or spaced-apart position on such surface, as shown in FIG. 5, and is activated to direct infrared rays from diode 32 against the rotating toy 30. Toy 30 will be guided toward transmitter 33 in a zigzag manner, all as shown hereinabove with respect to toy body 2, and body 30 will eventually arrive at transmitter 33 and receive the same within its mouth-simulative portion 30a just as though the same were a bone being grasped. Toy 30 upon receiving transmitter 33, as shown in FIG. 6, will thereupon rotate upon its axis as diode 35 will be denied effecting transmission to element 31.

It is, of course, apparent that an infrared responsive toy embodying the present invention may assume any suitable character since not only toy vehicles and dog and bone types are available as the potential range is indeed myriad. Thus, the system which ultimately rotates and advances should not be taken as limited to the precise structures shown in FIGS. 2(*a*), (*b*).

In recapitulation, it will be seen that the present invention contains a mobile body including a receiver for an infrared ray signal from a remotely located transmitter and a control circuit which controls the drive device in a switching operation whereby the mobile body is caused to rotate on its vertical axis when the receiver is not receiving infrared rays and wherein it advances along a straight line toward the receiver when the body does receive infrared rays. The area to be covered during the zigzag movement of the vehicle can of course be altered by the angle of radiation of the infrared rays from the transmitter. Only by transmission of infrared rays toward the mobile body rotating on its axis can the latter be automatically moved toward the transmitter.

What is claimed:

1. A light follow-up toy comprising a light transmitting source, said light source having a means restricting the angle of radiation of light, a mobile toy body having at least first and second aligned wheels, a reversible motor mounted in said body providing selective rotation operation in either first or second directions of rotation, first motion transmitting means connecting said motor to said first wheel in order to rotate said first wheel in both directions of rotation of the motor, second motion transmitting means connecting said motor to said second wheel but disconnecting said motor from said second wheel when said motor operates in the first direction of rotation but connecting said motor to said second wheel when said motor operates in the second direction of rotation, first power means causing said motor to rotate in said first direction whereby said toy will rotate about its vertical axis by reason of revolution only of said first wheel, second power means provided in said toy causing said motor to rotate in a second direction wherein said first and second wheels are caused to concurrently rotate in like direction; and light-responsive circuit means responsive to light received from said light source including a motor control circuit for normally causing said motor to be powered by said first power means in the absence of light received from said first power source but causing said motor to be powered by said second power source when said light is received from said light source.

2. A light follow-up toy as defined in claim 1 wherein said circuit means comprises a photosensitive element and circuitry for converting the light energy received by said element to an electric current for output to said motor control circuit.

3. Remote light controlled toy vehicle as defined in claim 2 wherein the angle of radiation of light from the transmitting source is within the range of approximately 60° to approximately 90°.

4. Remote light controlled toy vehicle as defined in claim 2 wherein the photosensitive element is located on said body for accepting the radiated light at a predetermined juncture of the rotation of the toy.

5. Remote light controlled toy vehicle as defined in claim 2 wherein the light transmitting source comprises an oscillator circuit for generating the predetermined frequency, an infrared diode, and means interconnecting said circuit and diode.

6. Remote light controlled toy vehicle as defined in claim 1 wherein said toy comprises a receptacle-forming portion, and said light transmitting source is sized for acceptance within said receptacle-forming portion.

7. Remote light controlled toy vehicle as defined in claim 6 wherein a photosensitive element is provided proximate said receptacle-forming portion for receiving light energy from said source, and circuit-forming means interconnecting said photosensitive element and said motor.

8. Remote light controlled toy vehicle as defined in claim 1 wherein the light transmitted is within the infrared range.

9. A light follow-up toy comprising a light transmitting source, said light source having a means restricting the angle of radiation of light, a mobile toy body having at least first and second aligned wheels, a reversible motor mounted in said body for providing selective rotation operation in either first or second directions of rotation, first gear train connecting said motor to said first wheel in order to provide both directions of rotation of the motor, a second gear train connecting said motor to said second wheel including a pinion for turning a shaft carrying said second wheel and a gear shiftable away from said pinion disengaging therefrom and disconnecting said motor and said second wheel when said motor operates in the first direction of rotation but shiftable toward said pinion into engagement with said pinion connecting said motor to said second wheel when said motor operates in the second direction of rotation, first power means causing said motor to rotate in said first direction whereby said toy will rotate about its vertical axis by reason of revolution only of said first wheel, second power means provided in said toy causing said motor to rotate in a second direction wherein said first and second wheels are caused to concurrently rotate in like direction; and light-responsive circuit means responsive to light received from said light source including a motor control circuit normally causing said motor to be powered by said first power means in the absence of light received from said first power source but causing said motor to be powered by said second power source when said light is received from said light source, the photosensitive element being located on said body for accepting the radiated light at a predetermined juncture of the rotation of the toy, the radiated light being within the infrared range.

* * * * *

UNITED STATES PATENT AND TRADEMARK OFFICE

CERTIFICATE OF CORRECTION

PATENT NO. : 4,828,525

DATED : May 9, 1989

INVENTOR(S) : M. Okano

It is certified that error appears in the above-identified patent and that said Letters Patent is hereby corrected as shown below:

Col. 8, line 8, after "pinion" delete "for".

Col. 8, line 30, after "body" delete "for".

Signed and Sealed this

Twentieth Day of February, 1990

*Attest:*

JEFFREY M. SAMUELS

*Attesting Officer*

*Acting Commissioner of Patents and Trademarks*